US010711713B2

(12) United States Patent
Brinkaemper et al.

(10) Patent No.: US 10,711,713 B2
(45) Date of Patent: Jul. 14, 2020

(54) FUEL TANK VENTING SYSTEM FOR A MOTOR VEHICLE

(71) Applicant: Daimler AG, Stuttgart (DE)

(72) Inventors: Udo Brinkaemper, Waiblingen (DE); Jens Gruener, Ostfildern (DE); Ramakrishnan Rajagopal, Singelfingen (DE)

(73) Assignee: Daimler AG, Stuttgart (DE)

( * ) Notice: Subject to any disclaimer, the term of this patent is extended or adjusted under 35 U.S.C. 154(b) by 382 days.

(21) Appl. No.: 15/650,120

(22) Filed: Jul. 14, 2017

(65) Prior Publication Data

US 2017/0314480 A1 Nov. 2, 2017

Related U.S. Application Data

(63) Continuation-in-part of application No. 14/374,482, filed as application No. PCT/EP2013/000144 on Jan. 18, 2013, now abandoned.

(30) Foreign Application Priority Data

Jan. 25, 2012 (DE) ..... 10 2012 001 314

(51) Int. Cl.
*F02D 41/00* (2006.01)
*F02M 25/08* (2006.01)

(52) U.S. Cl.
CPC ..... *F02D 41/0032* (2013.01); *F02D 41/0045* (2013.01); *F02M 25/089* (2013.01);
(Continued)

(58) Field of Classification Search
CPC ..... F02D 41/0032; F02D 41/0045; F02M 25/0827; F02M 25/0809; F02M 25/089; F02M 25/0854; F02M 25/0836
See application file for complete search history.

(56) References Cited

U.S. PATENT DOCUMENTS 5,002,090 A * 3/1991 Ichikawa ..... G01F 1/24 137/550
5,592,923 A * 1/1997 Machida ..... F02M 25/0809 123/520
(Continued)

FOREIGN PATENT DOCUMENTS

DE 10 2006 016 339 A1 10/2007
DE 10 2009 008 831 A1 8/2010
(Continued)

OTHER PUBLICATIONS

International Search Report (PCT/ISA/210) dated Aug. 2, 2013, with English translation (Seven (7) pages).
(Continued)

*Primary Examiner* — David Hamaoui
(74) *Attorney, Agent, or Firm* — Crowell & Moring LLP

(57) ABSTRACT

A fuel tank venting system for a motor vehicle includes an outlet side of a tank venting valve connected to an inlet side of a first vent line and to an inlet side of a second vent line. An outlet side of the first vent line is connected to an intake manifold upstream from a throttle valve and downstream from an air filter, and an outlet side of the second vent line is connected to the intake manifold downstream from the throttle valve. A position sensor may be located at a first position and the first closing element has a detectable element. The position sensor is connected to an electronic control device to transmit signals. A position of the first closing element may be determined by means of the position sensor and the detectable element.

19 Claims, 4 Drawing Sheets

(52) U.S. Cl.
CPC .... *F02M 25/0809* (2013.01); *F02M 25/0827* (2013.01); *F02M 25/0836* (2013.01); *F02M 25/0854* (2013.01)

(56) References Cited

U.S. PATENT DOCUMENTS

| | | | | |
|---|---|---|---|---|
| 7,400,955 | B2 * | 7/2008 | Baumann | F02M 25/0818 701/33.7 |
| 7,810,475 | B2 * | 10/2010 | Peters | F02M 25/089 123/519 |
| 8,662,119 | B2 | 3/2014 | Burris et al. | |
| 9,163,590 | B2 * | 10/2015 | Takeishi | F02M 25/0809 |
| 9,297,717 | B2 * | 3/2016 | Haag | B60K 15/03504 |
| 9,551,304 | B2 * | 1/2017 | Haefele | F02M 25/0809 |
| 2007/0239330 | A1 | 10/2007 | Baumann et al. | |
| 2011/0197864 | A1 * | 8/2011 | Karcher | F02M 25/06 123/574 |

FOREIGN PATENT DOCUMENTS

| | | | |
|---|---|---|---|
| DE | 10 2009 009 897 | A1 | 8/2010 |
| DE | 10 2009 024 697 | A1 | 12/2010 |
| JP | 4-194355 | A | 7/1992 |
| WO | WO 2009/106221 | A1 | 9/2009 |

OTHER PUBLICATIONS

German language Written Opinion (PCT/ISA/237) dated Aug. 2, 2013 (Eight (8) pages).

Meinig, et al., "Neue Anforderungen für Tankentlüftungssysteme", ATZ Automobiltechnische Zeitschrift 101 (1999) 3, pp. 166-173, (Twenty-four (24) pages, including seventeen (17) page translation).

* cited by examiner

FUEL TANK VENTING SYSTEM FOR A MOTOR VEHICLE

This application is a continuation in part of U.S. application Ser. No. 14/374,482 filed on Jul. 24, 2014, which is a National Stage application of PCT International Application No. PCT/EP2013/000144 filed on Jan. 18, 2013, which claims priority to under 35 U.S.C. § 119 to German Patent Application No. 10 2012 001 314.0 filed Jan. 25, 2012, the disclosures of which are expressly incorporated by reference herein.

BACKGROUND AND SUMMARY OF THE INVENTION

Exemplary embodiment of the invention relate to a fuel tank venting system for a motor vehicle and a method for diagnosing a fuel tank venting system.

The basic design of conventional fuel tank venting systems for motor vehicles and their function is described, for example, in ATZ Automobiltechnische Zeitschrift 101 (1999) 3, pages 166-173.

German patent document DE 10 2009 008 831 A1 discloses a fuel tank venting system of the generic kind. Upstream from a throttle valve, a first vent line is connected to an intake manifold of a motor vehicle via a first check valve. Downstream from the throttle valve, a second vent line is connected to the intake manifold via a second check valve. In this system, it is possible to detect leaks in the first or second vent line up to the position of the first check valve, using an intake manifold pressure sensor which is already present in the intake manifold. In this system configuration, a leak between the first check valve and the intake manifold cannot be detected. However, since the regulatory requirements in the United States stipulate that all types of leaks or blockages must be detectable unless components are connected via nondetachable connections, German patent document DE 10 2009 008 831 A1 proposes connecting the first check valve to the intake manifold via a nondetachable connection. For this purpose, the first check valve is positioned very closely to the intake manifold, at the end of the first vent line. This system has a drawback with regard to repair shop user-friendliness, since removal or replacement of the intake manifold can take place only together with the first check valve.

In addition, PCT publication WO 2009/106221 A1 discloses a check valve having a distance sensor, in which a movable part of the distance sensor is connected to a closing element of the check valve. The movable part may be a permanent magnet. A position of the permanent magnet, and thus of the closing element, may be measured using a Hall sensor. It is proposed to thus measure a volume flow of a fluid flowing through the check valve.

Exemplary embodiments of the present invention are directed to improving the repair shop user-friendliness of the generic fuel tank venting system while ensuring continued diagnostic capability in compliance with regulatory requirements.

The fuel tank venting system has an intake manifold for supplying air to a cylinder of an internal combustion engine of the motor vehicle, the intake manifold including a throttle valve and, upstream from the throttle valve, an air filter. In addition, the fuel tank venting system has a fuel tank, a tank vent valve, a cutoff valve, and an electronic control device, the electronic control device being connected to the throttle valve, the tank vent valve, and the cutoff valve, in each case for the purpose of controlled actuation. The control device may be a control unit or an assembly of multiple control units that are interconnected via communication connections. The connection between the electronic control device and the throttle valve, the tank vent valve, and the cutoff valve may be wired or wireless. Furthermore, the fuel tank venting system has a first vent line that includes a first check valve having a first closing element, and a second vent line, the cutoff valve being indirectly or directly connected to an inlet side of the tank vent valve, and an outlet side of the tank vent valve being connected to an inlet side of the first vent line and to an inlet side of the second vent line. The closing element of the check valve may be designed as a sphere, cone, flap, or diaphragm, or as some other known closing element.

An outlet side of the first vent line is connected to the intake manifold upstream from the throttle valve and downstream from the air filter, and an outlet side of the second vent line is connected to the intake manifold downstream from the throttle valve. The terms "upstream" and "downstream" refer to a direction of an air flow in the intake manifold.

According to the invention, a position sensor may be positioned at the first check valve for determining a position of a detectable element of the first closing element, the position sensor being connected to the electronic control device for the purpose of signal transmission. Here as well, the mentioned connection may be implemented in a wired or wireless manner.

In the mentioned system configuration, by means of the position sensor and the detectable element of the first check valve it is possible to detect leaks or obstructions in the first vent line. The leaks or obstructions may be detected over the entire distance between the tank vent valve, over the first vent line up to the intake manifold, i.e., up to the air filter.

A first advantageous refinement of the invention provides that the detectable element includes a magnet element, and the position sensor includes a Hall sensor. A magnet element may be mounted on or in the closing element in a cost-effective manner. A position of the magnet element, and thus of the first closing element, may be determined by means of the Hall sensor. In this case, the Hall sensor may be mounted in a flow channel of the check valve, or particularly advantageously, also outside the flow channel. A mounting outside the flow channel is cost-effective and robust.

The closing element is particularly advantageously designed in such a way that its position changes only in one direction during opening and closing, i.e., primarily in such a way that the closing element cannot rotate during opening and closing. This type of design is provided, for example, as a flap that is fastened on one side, or a diaphragm that is fastened on one side. Another advantageous refinement therefore provides that the first closing element includes a non-return flap. The non-return flap particularly advantageously has a leaf spring, the leaf spring exerting a force on the non-return flap in the direction of a closed position of the non-return flap. The check valve may thus be installed in the motor vehicle independently of position, since closing of the closing element occurs primarily due to an elastic force of the leaf spring, not due to gravity.

Another advantageous refinement provides that the second vent line includes a second check valve having a second closing element. In this case, a leak in the second vent line may advantageously be detected by means of an intake manifold pressure sensor situated in the intake manifold, downstream from the throttle valve or using the position sensor in the first check valve or a combination of both.

Another advantageous refinement provides that the first check valve and the second check valve are situated in a shared housing and form a double check valve, an inlet side of the double check valve at the same time forming the inlet side of the first vent line and the inlet side of the second vent line. Costs and space requirements may thus be reduced in the fuel tank venting system according to the invention.

Another advantageous refinement of the invention provides that a crankcase vent line is connected to the first vent line. This has the advantage that not only leaks in the first vent line, but also a disconnection or equivalent leaks of the crankcase vent line may be detected by means of the position sensor.

Another advantageous refinement of the invention provides that the intake manifold has a turbocharger upstream from the throttle valve. When the fuel tank venting system contains the turbocharger upstream from the throttle valve, there is no negative pressure in the intake manifold downstream from the throttle valve during full load operation of the internal combustion engine, and instead, there is a negative pressure upstream from the turbocharger. In this configuration, the first vent line opens into the intake manifold upstream from the turbocharger. Due to the negative pressure generated by the turbocharger under full load, leak detection may be carried out particularly easily by the position sensor.

The method for diagnosing a fuel tank venting system of a motor vehicle is characterized by a fuel tank venting system according to the invention, whereby a piece of error information is stored in the electronic control device, when a closed position of the first closing element is determined by means of the position sensor, and a full load regeneration operation is present, and a piece of error information is stored in the electronic control device when an open position of the first closing element (12) is determined by means of the position sensor and no full load regeneration operation is present.

The presence of a full load regeneration operation or a part-load regeneration operation is a function of a load on the internal combustion engine and a switching position of the tank vent valve, whereby the load on the internal combustion engine may be derived from measurement variables and/or control variables, for example a throttle valve position and engine speed. A full load regeneration operation is present when inlet manifold pressure is more than atmospheric pressure, and at the same time the tank vent valve is open. A part-load regeneration operation is present when inlet manifold pressure is less than the atmospheric pressure and at the same time the tank vent valve is open. The method is carried out according to the invention by means of the electronic control device, which is connected to all relevant electrical and electronic components and which has means for data processing.

A refinement of the method for diagnosing provides that the second vent line includes a second check valve having a second closing element, wherein A leak and an obstruction of the second vent line may be reliably detected with the aid of the position sensor and the first detectable element.

BRIEF DESCRIPTION OF THE DRAWINGS

The invention is described below with reference to exemplary embodiments and associated drawings from which further features and advantages of the invention result. Identical elements are provided with the same reference numerals in the drawings.

The figures show the following.

DETAILED DESCRIPTION OF THE DRAWINGS

Figure 1:
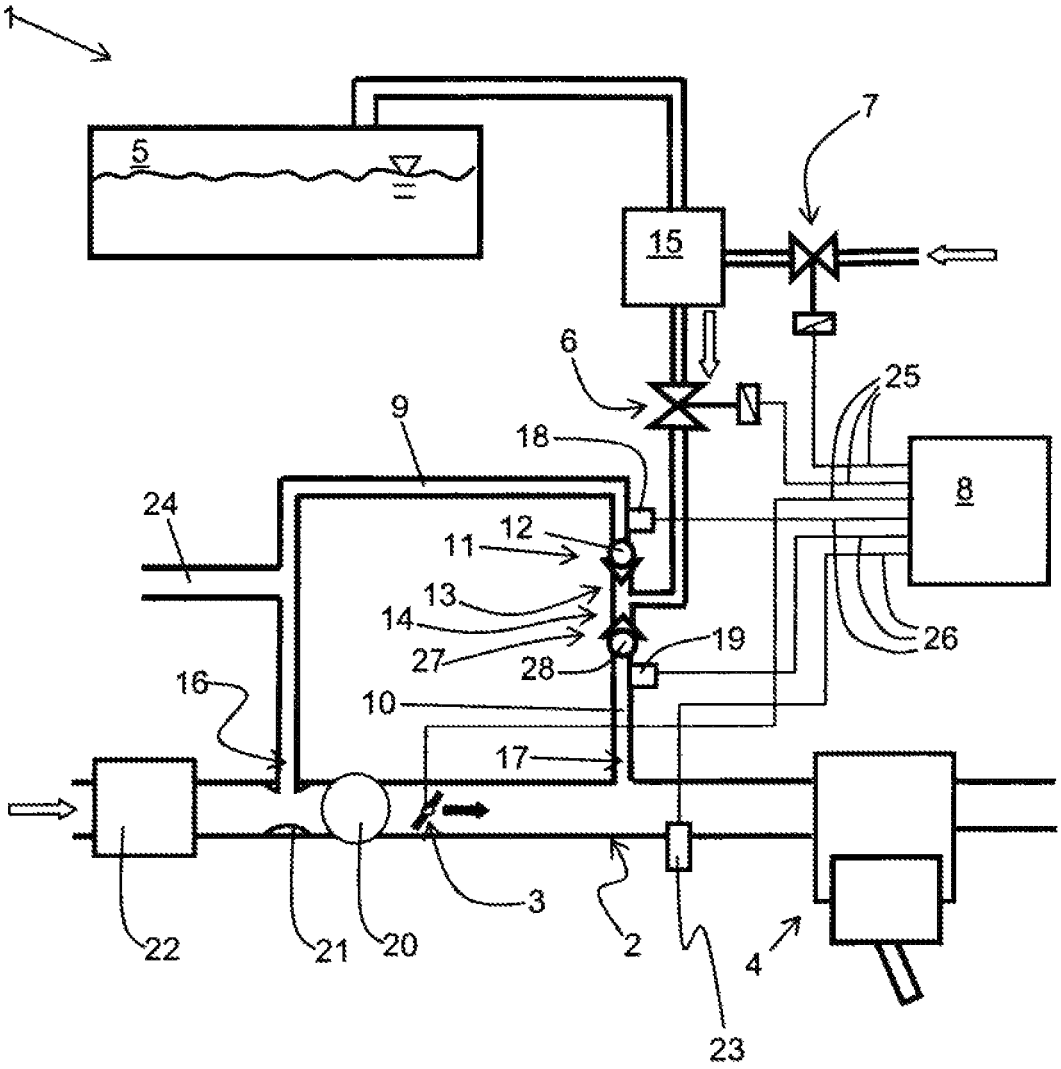
FIG. 1 shows a schematic illustration of a fuel tank venting system.

FIG. 1 shows a schematic illustration of a fuel tank venting system 1 of a motor vehicle, not illustrated in greater detail. The fuel tank venting system 1 includes an intake manifold 2 having a throttle valve 3, an intake manifold pressure sensor 23 of a Venturi throat 21, a turbocharger 20, and an air filter 22. The intake manifold 2 is connected to a cylinder 4 of an internal combustion engine, not illustrated in greater detail. The fuel tank venting system 1 also has a fuel tank 5, which at its top side is connected to an activated carbon container 15. The connection may include further components, such as a valve. The activated carbon container 15 is connected to the atmosphere via a cutoff valve 7, and is connected to an inlet side 13 of a first vent line 9 and to an inlet side 14 of a second vent line 10 via a tank vent valve 6. An outlet side 16 of the first vent line 9 is connected to the intake manifold 2 at the Venturi throat 21, upstream from the turbocharger 20. An outlet side 17 of the second vent line 10 is connected to the intake manifold 2 downstream from the throttle valve 3. In the area of its inlet side 13, the first vent line 9 contains a first check valve 11 having a first closing element 12, the first check valve 11 opening in the direction of the outlet side 16. In the area of its inlet side 14, the second vent line 10 contains a second check valve 27 having a second closing element 28, the second check valve 27 opening in the direction of the outlet side 17. The first check valve 11 and the second check valve 12 are advantageously integrated into a shared housing for a double check valve. In a preferred embodiment, the fuel tank venting system 1 may use a single position sensor. The position sensor may be arranged at a first position 18 in the first check valve 11. Alternatively, the position sensor may be arranged at a second position 19 in the second check valve 27. Regardless of whether the position sensor is located at the first position 18 or second position 19, the position sensor is used for a diagnostic method for detecting leaks or obstructions of the first vent line 9 and for detecting leaks or obstructions of the second vent line 10. In an alternative embodiment, a first position sensor may be arranged at the first position 18 and a second position sensor may be arranged at the second position 19.

The first vent line is connected to a crankcase vent line 24 in the area between the first check valve and the outlet side 16, the fuel tank venting system 1 according to the invention also including an alternative junction of the crankcase vent line 24 directly into the intake manifold 2; in the latter case the crankcase vent line 24 opens into the intake manifold 2 between the turbocharger 20 and the air filter 22.

The fuel tank venting system also has an electronic control device 8 which is an engine control unit, a tank control unit, or an assembly of control units, for example. The electronic control device 8 is connected to the electronically controllable tank vent valve, the electronically controllable cutoff valve 7, and the electronically actuatable throttle valve via control lines 25. Alternatively, the throttle valve 3, the tank vent valve 6, and the cutoff valve 7 may be pneumatically or hydraulically actuatable, in which case hydraulic or pneumatic actuators would be controlled by the electronic control device.

The electronic control device 8 is also connected to the intake manifold pressure sensor 23, the position sensor at position 18 (or, alternatively, the position sensor at position 19) via signal lines 26. The electronic control device 8 is also connected (not illustrated in FIG. 1) to a position sensor of the throttle valve 3 via a signal line.

Figure 2:
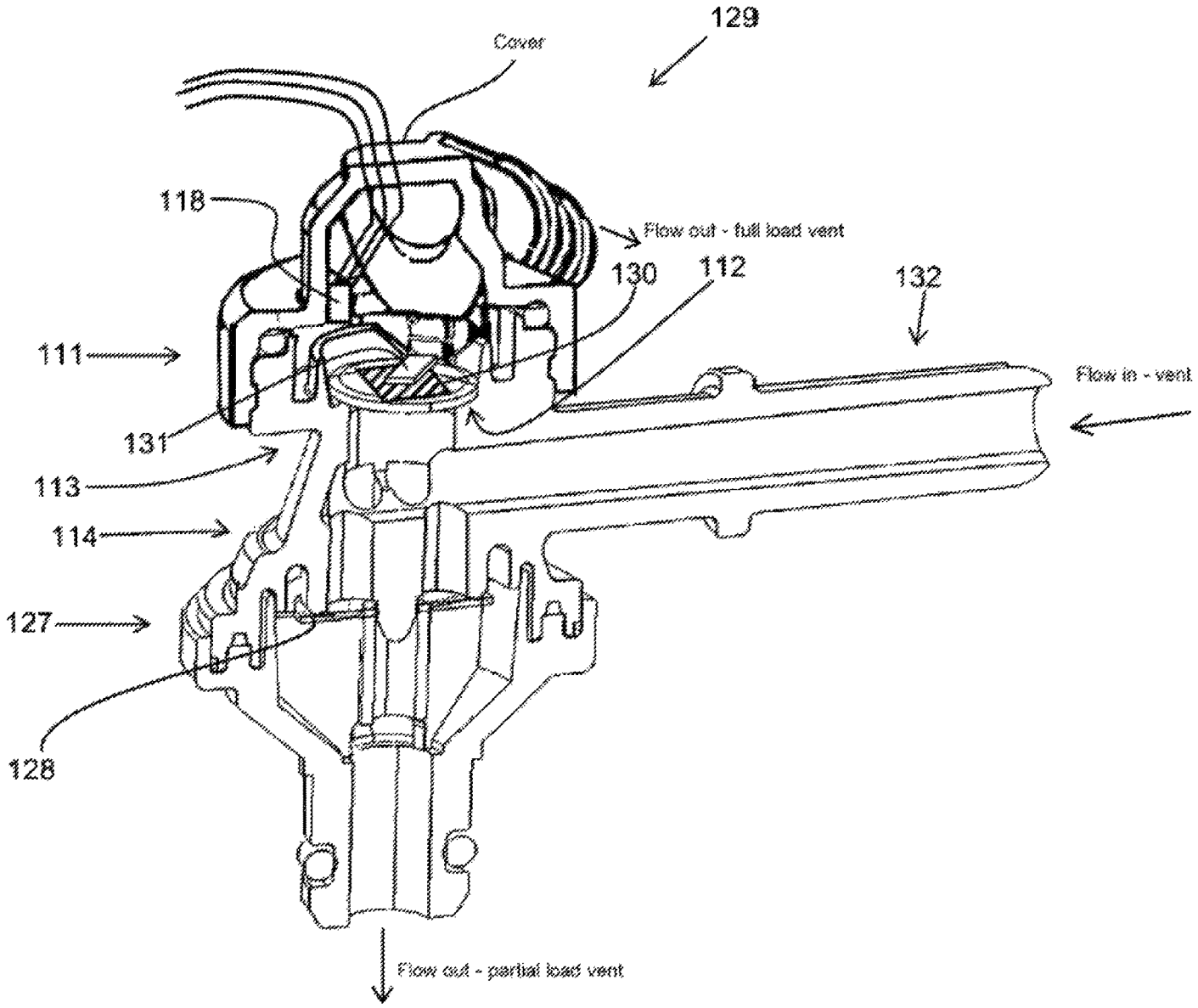
FIG. 2 shows a design representation of a double check valve together with a position sensor.

FIG. 2 shows a design representation of a double check valve 129, which includes the first check valve 111 and the second check valve 127. A position sensor 118, in the form of a Hall sensor, may be located at and/or near the first check valve 111. A position of a first detectable element 130, which in the present case is in the form of a permanent magnet (e.g., disc magnet with S/N polarization), may be determined by means of the position sensor 118. The first detectable element 130 is situated and/or embedded on the first closing element 112, the first closing element 112 being a non-return flap (e.g., rubber flap valve hinged at the cover). Likewise situated above the first closing element 112 is a spring element 131 (e.g., leaf spring hinged at the cover) which is used to hold the first closing element 112 in a closed position until there is no pressure drop in the direction of the outlet side 16 of the first vent line 9. Moreover, the second check valve 127 includes a second closing element 128, which can also be a non-return flap (e.g., rubber flap). The double check valve 129 has a connecting point 132 which is connected to the tank vent valve 6. An area around the first check valve 111 forms the inlet side 113 of the first vent line 9, and an area around the second check valve 127 forms the inlet side 114 of the second vent line 10.

Leaks and obstructions in the first vent line 9 may be detected by means of the position sensor 118 of the double check valve 129. For the case that the intake manifold 2 has an intake manifold pressure sensor 23, the double check valve 129 advantageously has no position sensor at the second check valve 127, since in this case leaks and obstructions in the second vent line 10 may be detected by means of the intake manifold pressure sensor 23.

In accordance with another aspect of the invention, only a single sensing element (e.g., either at the first position 18 or the second position 19) may be used to diagnose both the first and second check valves as well as the complete venting system, such that the use of any pressure sensing elements to determine the operability of the check valve(s) is unnecessary. For example, the first closing element 112 and the second closing element 128 are moved simultaneously. In at least that regard, the position of the second closing element 128 may be detected via the position sensor 118 sensing the position of the first closing element 112. As such, only a single sensing element or sensor is needed (e.g., at the first position 18 or the second position 19).

By way of example, the single sensor may be arranged at or near a position where the first check valve 11 is arranged in FIG. 1 or may be arranged at or near a position where the second check valve 27 is arranged in FIG. 1. The double check valve 129 of FIG. 2 illustrates the single sensor (e.g., position sensor 118) arranged at or near the position where the first check valve 11 is arranged. For instance, the spring element 131 (e.g., the leaf spring) may keep the first closing element 112 at a neutral position (e.g., neither fully open nor fully closed) when the pressure across it is zero.

During part load regeneration, for example, the second closing element 128 may be opened, which may create a pressure drop between the first closing element 112 and the second closing element 128. Thus, the first closing element 112 may be forced to the completely closed position depending on the pressure drop. The position sensor 118 may read the degree of opening of the first closing element 112 and a regeneration value may be determined, calculated, and/or deduced from the determined degree of opening.

During full load regeneration, for example, the second closing element 128 may remain closed and the first closing element 112 may be pulled to the fully open position depending on the low pressure created by the Venturi. The position sensor 118 may read the degree of opening of the first closing element 112 and a regeneration value may be determined, calculated, and/or deduced from the determined degree of opening.

The detection of fault in a part-load or full load tank/crank case ventilation will be described. In one example, the full load vent line may be open to atmosphere. In this example, during turbocharged engine operation, the Venturi may produce suction pressure. Since the full load vent line is open to atmosphere, the vacuum pressure is not available at the first closing element 112, which would thus remain in the neutral position. In another example, the part-load vent line may be open to atmosphere. During part-load, there may be no vacuum pressure available at the second closing element 128. Thus, the first closing element 112 remains in the neutral position.

The spring element 131 may be, in examples, a double acting leaf spring. It may be understood that the leaf spring may be configured as a separate element or the first and second closing elements 112 and 128, respectively, may be contoured or designed to have similarly desired characteristics.

Figure 3:
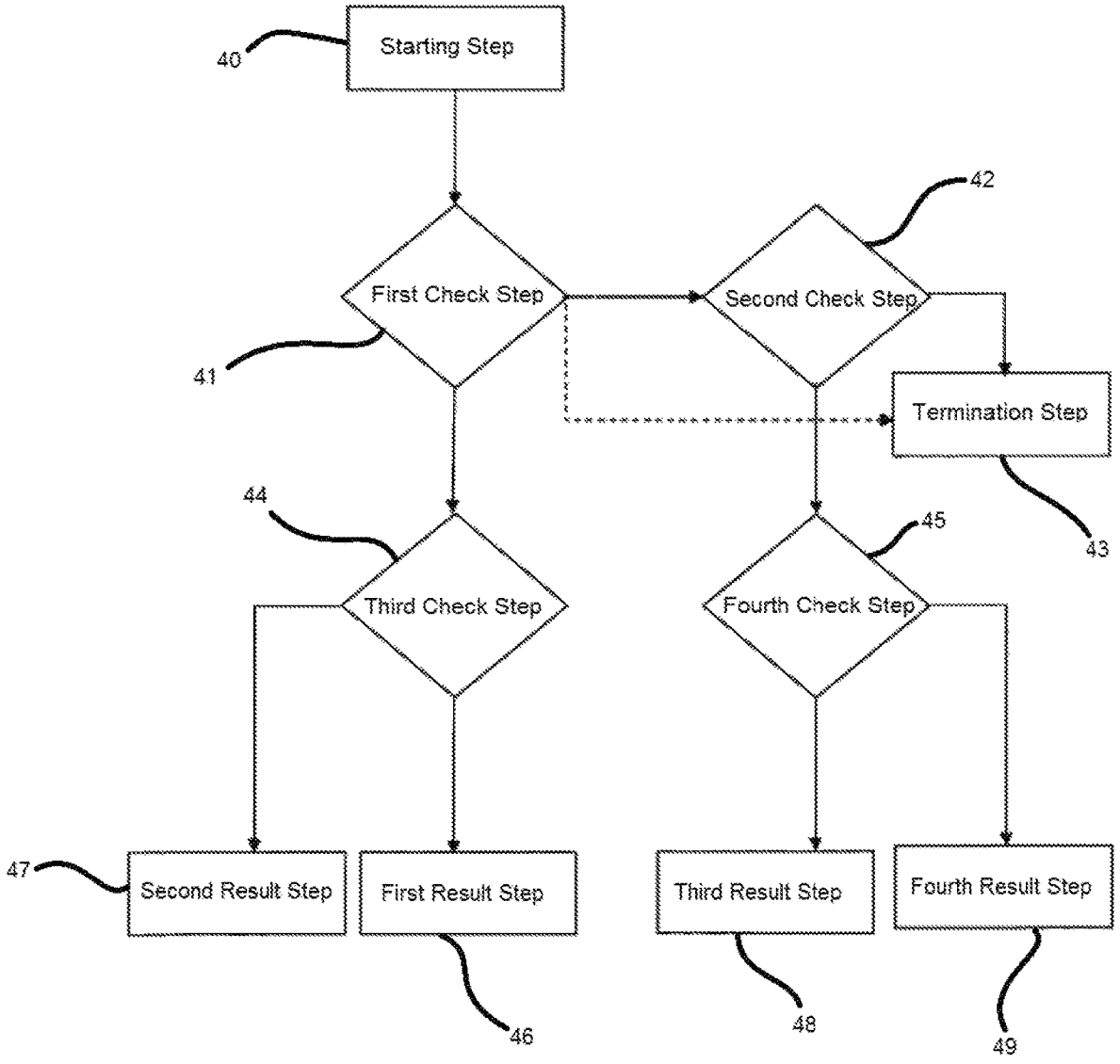
FIG. 3 shows a flow diagram for a method for diagnosing a fuel tank venting system.

FIG. 3 shows a flow diagram for a method for diagnosing a fuel tank venting system 1.

The diagnostic method begins with a starting step 40 in which a check is made as to whether suitable operating conditions of the internal combustion engine are present for the method. If these conditions are present, a first check step 41 follows in which a check is made as to whether a full load regeneration operation of the tank venting system 1 is present. If a full load regeneration operation is present, a third check step 44 follows in which a check is made by means of the position sensor 118 at position 18 as to whether the first closing element 12, 112 is in an open position. If the first closing element 12, 112 is in an open position, the method is terminated with a first result step 46, a piece of information concerning the absence of an error in the first vent line being stored. If the first closing element 12, 112 is in a closed position, the method is terminated with a second result step 47, a piece of information concerning the presence of an error in the first vent line being stored, since in this method step the closed first closing element 12, 112 indicates that a pressure drop over the first check valve 11, 111, which would indicate a leak or an obstruction of the first vent line 9, is not present.

If it is established in the first check step 41 that a full load regeneration operation is not present, either a termination step 43 follows, namely, when the second vent line is not to be monitored using this method, or a second check step 42 is carried out in which a check is made as to whether a part-load regeneration operation is present. If no part-load regeneration operation is present, the termination step 43 is carried out; otherwise, a fourth check step 45 is made in which a check is made by means of the position sensor as to whether the vacuum pressure is propagated from the manifold. If the vacuum pressure is propagated as indicated by the position sensor, the method is terminated with a third result step 48, a piece of information concerning the absence of an error in the second vent line being stored. If the vacuum pressure is not propagated as indicated by the position sensor, the method is terminated with a fourth result step 49, a piece of information concerning the presence of an error in the second vent line 10 being stored.

Figure 4:
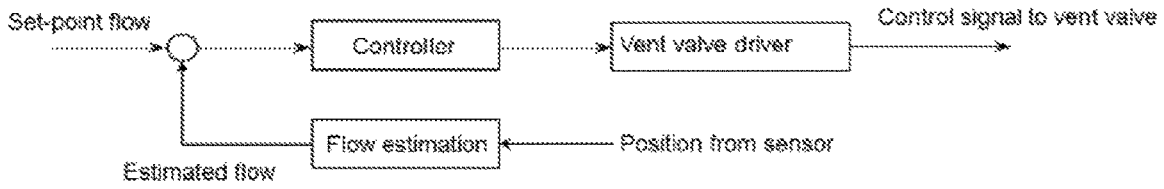
FIG. 4 shows a flow diagram for controlling vent valve of a fuel tank venting system.

FIG. 4 shows a flow diagram for controlling a vent valve of a fuel tank venting system.

For example, the position of the first closing element 112 and/or the second closing element 128 measured by the position sensor 118 may be used for flow estimation. Thereafter, the estimated flow may be sent to and received by the controller for further processing. In addition, a set-point flow may also be sent to and received by the controller with the estimated flow in order to control the vent valve (e.g., tank vent valve 6) of the fuel tank venting system. The set-point flow, for instance, may be determined from an actual charge (e.g., electrostatic attraction) of an Evaporative Emission Control System (EVAP) canister (e.g., the activated carbon container 15) and/or engine operating load, where charge modeling may be based on the principles of evaporation of fuel and adsorption. Evaporation of the fuel, such as gasoline, may depend on fuel tank temperature, fuel tank pressure, atmospheric pressure, and/or the filling level. Moreover, adsorption may depend on the actual charge of the EVAP canister, canister adsorption capacity, ambient temperature, and/or evaporative feed and purge rate. Evaporation and/or adsorption values may be detected or measured by any suitable type of sensor(s) and/or may be predetermined measured values. The controller then controls a vent valve driver, as shown in FIG. 4, in order to send a control signal to a vent valve (such as the tank vent valve 6) for controlling vent flow in the fuel tank venting system.

One of the numerous advantages of the present invention is that the invention considers the fuel tank and the crankcase venting system together. Another advantage is that only one sensing element is used to diagnose both check valves and the complete venting system, as set forth above.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

LIST OF REFERENCE NUMERALS

1 Fuel tank venting system
2 Intake manifold
3 Throttle valve
4 Cylinder
5 Fuel tank
6 Tank vent valve
7 Cutoff valve
8 Electronic control device
9 First vent line
10 Second vent line
11, 111 First check valve
12, 112 First closing element
13, 113 Inlet side of the first vent line
14, 114 Inlet side of the second vent line
15 Activated carbon container
16 Outlet side of the first vent line
17 Outlet side of the second vent line
18 First position for the position sensor
19 Alternative position (second position) for the position sensor
20 Turbocharger
21 Venturi throat
22 Air filter
23 Intake manifold pressure sensor
24 Crankcase vent line
25 Control lines
26 Signal lines
27, 127 Second check valve
28, 128 Second closing element
129 Double check valve
130 First detectable element
131 Spring element
132 Connecting point
40 Starting step
41 First check step
42 Second check step
43 Termination step
44 Third check step
45 Fourth check step
46 First result step
47 Second result step
48 Third result step
49 Fourth result step

What is claimed is:

1. A method for diagnosing a fuel tank venting system, wherein the fuel tank venting system includes an intake manifold configured to supply air to a cylinder of an internal combustion engine of the motor vehicle, the intake manifold including a throttle valve and an air filter; a fuel tank; a tank vent valve having an inlet side and an outlet side; a cutoff valve; an electronic control device configured to actuate the throttle valve, the tank vent valve, and the cutoff valve; a first vent line having a first check valve with a first closing element; and a second vent line having a second check valve with a second closing element, wherein the cutoff valve is indirectly or directly connected to the inlet side of the tank vent valve, and the outlet side of the tank vent valve is connected to an inlet side of the first vent line and to an inlet side of the second vent line, wherein an outlet side of the first vent line is connected to the intake manifold upstream from the throttle valve and downstream from the air filter, and an outlet side of the second vent line is connected to the intake manifold downstream from the throttle valve, the method comprising the steps of:

performing a regeneration operation by simultaneously opening the tank vent valve and the cutoff valve;

determining, during the regeneration operation, whether a full load regeneration operation or a part-load regeneration operation is present as a function of a degree of opening of the throttle valve; and (i) detecting a position of the first closing element of the first check valve via a position sensor and (ii) determining a position of the second closing element of the second check valve based on the detected position of the first closing element, or (i) detecting the position of the second closing element of the second check valve via the position sensor and (ii) determining the position of the first closing element of the first check valve based on the detected position of the second closing element, wherein a piece of error information is stored in the electronic control device when a closed position of the first closing element is determined by the position sensor and a full load regeneration operation is present, and wherein a piece of error information is stored in the electronic control device when an open position of the first closing element is determined by the position sensor and no full load regeneration operation is present.

2. The method of claim 1, wherein the position of the first closing element is detected when the position sensor is arranged at or adjacent to the first check valve, and the position of the second closing element is detected when the position sensor is arranged at or adjacent to the second check valve.

3. The method of claim 1, wherein the position sensor is a Hall sensor.

4. The method of claim 1, wherein a detectable element is connected to the first closing element, and the detectable element is a magnet element.

5. The method of claim 1, wherein the first closing element is a non-return flap having a spring element, and the spring element is configured to exert a force on the non-return flap.

6. The method of claim 1, wherein the first check valve and the second check valve are situated in a shared housing as a double check valve.

7. The method of claim 6, wherein an inlet side of the double check valve forms both the inlet side of the first vent line and the inlet side of the second vent line.

8. The method of claim 1, wherein a crankcase vent line is indirectly or directly connected to the first vent line.

9. The method of claim 1, wherein the intake manifold has a turbocharger upstream from the throttle valve and downstream from a junction of the first vent line.

10. The method of claim 1, wherein the first check valve and the second check valve are both diagnosable via solely the position sensor.

11. The method of claim 10, wherein the fuel tank venting system is diagnosable via solely the position sensor.

12. The method of claim 10, wherein operability of the first check valve or the second check valve is not determined via a pressure sensing element.

13. The method of claim 1, wherein the first closing element and the second closing element are configured to move simultaneously.

14. The method claim 1, wherein the position of the first closing element detected by the position sensor includes a degree of opening of the first closing element and wherein the electronic control device receives the reading and determines a regeneration value based on the degree of opening.

15. The method of claim 14, wherein the degree of opening varies based on whether the fuel tank venting system is operated during part load regeneration or full load regeneration.

16. The method of claim 5, wherein the spring element is a leaf spring.

17. The method of claim 1, wherein the electronic control device is configured to control the tank vent valve based on an estimated flow and a set-point flow.

18. The method of claim 17, wherein the estimated flow is based on the position of the first closing element and the set-point flow is based on evaporation of fuel and adsorption.

19. The method of claim 18, wherein the evaporation of fuel is dependent on one or more of the following: (i) fuel tank temperature, (ii) fuel tank pressure, (iii) atmospheric pressure, and (iv) filling level, and wherein the adsorption is dependent on one or more of the following: (i) an actual charge of a canister, (ii) canister adsorption capacity, (iii) ambient temperature, and evaporative feed and purge rate.

* * * * *